United States Patent [19]

Snyder, Jr. et al.

[11] Patent Number: 5,015,151

[45] Date of Patent: May 14, 1991

[54] MOTOR CONTROLLER FOR ELECTRICAL SUBMERSIBLE PUMPS

[75] Inventors: Dale R. Snyder, Jr., Houston; Joe H. Haws, Richmond, both of Tex.

[73] Assignee: Shell Oil Company, Houston, Tex.

[21] Appl. No.: 523,296

[22] Filed: May 14, 1990

Related U.S. Application Data

[63] Continuation of Ser. No. 396,780, Aug. 21, 1989, abandoned, which is a continuation of Ser. No. 13,094, Feb. 10, 1987, abandoned.

[51] Int. Cl.[5] ..... F04B 49/00

[52] U.S. Cl. ..... 417/18; 417/44; 417/45; 417/53

[58] Field of Search ..... 417/12, 17, 18, 44, 417/45, 53

[56] References Cited

U.S. PATENT DOCUMENTS

| | | | |
|---|---|---|---|
| 2,707,440 | 5/1955 | Long et al. . | |
| 2,774,929 | 12/1956 | Schaefer | 318/474 |
| 3,105,442 | 10/1963 | Johnson | 103/12 |
| 3,408,940 | 11/1968 | McGrogan . | |
| 3,568,771 | 3/1971 | Vincent | 417/45 |
| 3,610,779 | 10/1971 | Hubby | 417/5 |
| 3,918,843 | 11/1975 | Douglas et al. | 417/12 |
| 3,936,231 | 2/1976 | Douglas | 417/12 |
| 3,953,777 | 4/1976 | McKee | 417/95 |
| 3,972,648 | 8/1976 | Sangster | 417/12 |
| 4,057,365 | 11/1977 | Colmer | 417/44 |
| 4,076,457 | 2/1978 | Skinner | 417/53 |
| 4,108,574 | 8/1978 | Bartley | 417/19 |
| 4,180,374 | 12/1979 | Bristow | 417/12 |
| 4,204,808 | 5/1980 | Reese | 417/45 |
| 4,259,038 | 3/1981 | Jorgensen | 417/53 |
| 4,302,157 | 11/1981 | Welton et al. | 417/12 |
| 4,302,158 | 11/1981 | Brown | 417/20 |
| 4,329,120 | 5/1982 | Walters | 417/12 |
| 4,370,098 | 1/1983 | McClain et al. | 417/18 |
| 4,473,338 | 9/1984 | Garmong | 417/12 |
| 4,507,053 | 3/1985 | Frizzell | 417/12 |
| 4,511,312 | 4/1985 | Hartwig | 417/53 |
| 4,628,234 | 12/1986 | Mizuta | 318/267a |
| 4,641,067 | 2/1987 | Iizawa | 318/286 |

OTHER PUBLICATIONS

New Pump-Off Controls Improve Performance by J. F. Lea, Petroleum Engineer International, Dec. 1986.

*Primary Examiner*—Leonard E. Smith
*Assistant Examiner*—David W. Scheuermann

[57] ABSTRACT

Differential motor load drops are employed to indicate gas lock or pump off of an electrical submersible pump.

36 Claims, 2 Drawing Sheets

MOTOR CONTROLLER FOR ELECTRICAL SUBMERSIBLE PUMPS

This is a continuation of application Ser. No. 396,780, filed Aug. 21, 1989, which is a continuation of application Ser. No. 013,094, filed Feb. 10, 1987, abandoned.

BACKGROUND OF THE INVENTION

The use of soft starters for electrical submersible pumps (ESP's) within the past few years has led to an opportunity to increase production by pumping ESP's off, i.e., pumping well fluid levels down to the pump intake in order to obtain maximum production from a well by lowering its bottomhole pressure. Operating an ESP in this mode means that the ESP is continually cycled on and off as the unit is pumped off, shut down for a short period of time to allow the well to partially fill, and then restarted. This could not have been done prior to the use of soft starters since ESP failure was common on restart.

Besides minimizing restarting failures, ESP pump off operation also requires reliable pump off detection and control to not allow an ESP to operate after it has become gas-locked. Failure to shut down a gas locked ESP will result in premature failure due to overheating. Gas locking occurs when an ESP ingests sufficient gas so as to no longer be able to pump fluid to the surface, the result of either large gas bubbles being present in the well fluid or of the pump intake being uncovered at pump off. In accordance with the present invention an ESP pump off controller has been developed to meet the needs of reliably detecting and shutting down an ESP when gas locked or pumped off since existing ESP motor controllers have been proven to inadequately control under these critical conditions.

Existing ESP motor controllers have been adapted from surface motor control packages where motor operation is more stable and motor control is less critical. For example, it not critical for a motor controller to prevent a surface centrifugal pump from running dry since this will not damage the pump or its motor, but a downhole ESP will fail rapidly if it is run after losing fluid flow to the surface. These motor controllers monitor the running current (or power consumption) of the motor and compare it to a manually adjustable, fixed setpoint. When the current drops below this underload setpoint for a prescribed length of time, the motor is shut down.

Experience has shown that this existing method of motor control is unreliable since pumping ESP's are seen to be prematurely shutting down in underload or not at all. The reason for this unreliability is that the manually entered setpoints are often guessed, or at best, based on varying rules of thumb which may have no correlation to what is going on downhole. As a result, setpoints are frequently set too high causing premature shutdown and loss of production or set too low failing to shut the ESP down, causing failure of the ESP and loss of production.

Applicants are not aware of any prior art which, in their judgment as persons being skilled in this particular art, would anticipate or render obvious this novel technique of the present invention; however, for the purposes of fully developing the background of the invention, and establishing the state of the requisite art, the following are set forth: U.S. Pat. Nos. 4,302,157; 4,302,158; 2,774,929; 4,057,365; *Petroleum Engineer International*, December 1986, pp. 41–44.

SUMMARY OF THE INVENTION

The primary purpose of the present invention is to provide a method and apparatus for shutting down an electrical submersible pump motor (ESP) when a motor underload has occurred, for example due to pump off or gas lock. Gas locking and pump off have been found, as discovered in accordance with the present invention, to be characterized by a sudden drop in motor load when gas enters the pump. The present invention provides several alternative methods and apparatus to reliably determine if ESP gas locking or pump off has occurred by measuring ESP operating parameters at the surface. Each method uses the following logic: (1) Computations are performed on measured motor load to determine if a drop in motor load has occurred. (2) For non-gassy pumping applications, the ESP is shut down on the first indication of a drop in motor load. This will occur at pump off; gas will not enter the pump and cause motor load to drop until the fluid level in the well is pumped down and the pump intake is uncovered. (3) For gassy pumping applications, the ESP is shut down only when it gas-locks. Motor load will drop each time gas enters the pump, but will recover when the gas exits with the pump fluid. When a large amount of gas enters the pump and the pump becomes gas-locked, motor load will drop but will not recover since the gas is trapped in the pump. In this application, the ESP is shut down if motor load drops and does not recover within an adequate length of time.

Preferably, the above described operations are conducted in accordance with the following method (and apparatus for conducting the method) for detecting differential pump fluid power output or loss of pump fluid power output (or electrical submersible pump motor underload), comprising: measuring pump motor power consumption (or measuring motor loads) at timed intervals; determining a recent pump motor power consumption (or motor load) from the measurements; determining a previous pump motor power consumption (or motor load) from the measurements; deriving the difference between the former two steps; and denoting the difference as differential pump fluid power output (or as indicative of pump motor underload when said difference exceeds a predetermined quantity). Preferably, the method (and apparatus for conducting the method) includes shutting the pump (or pump motor) down when the differential pump fluid power output exceeds a predetermined amount for a predetermined length of time (or when an underload is detected or alternatively, shutting the pump motor down when an underload is detected which exceeds a predetermined length of time).

Other purposes, distinctions over the art, advantages and features of the invention will be apparent to one skilled in the art upon review of the following:

DESCRIPTION OF PREFERRED EMBODIMENTS

Figure 1:
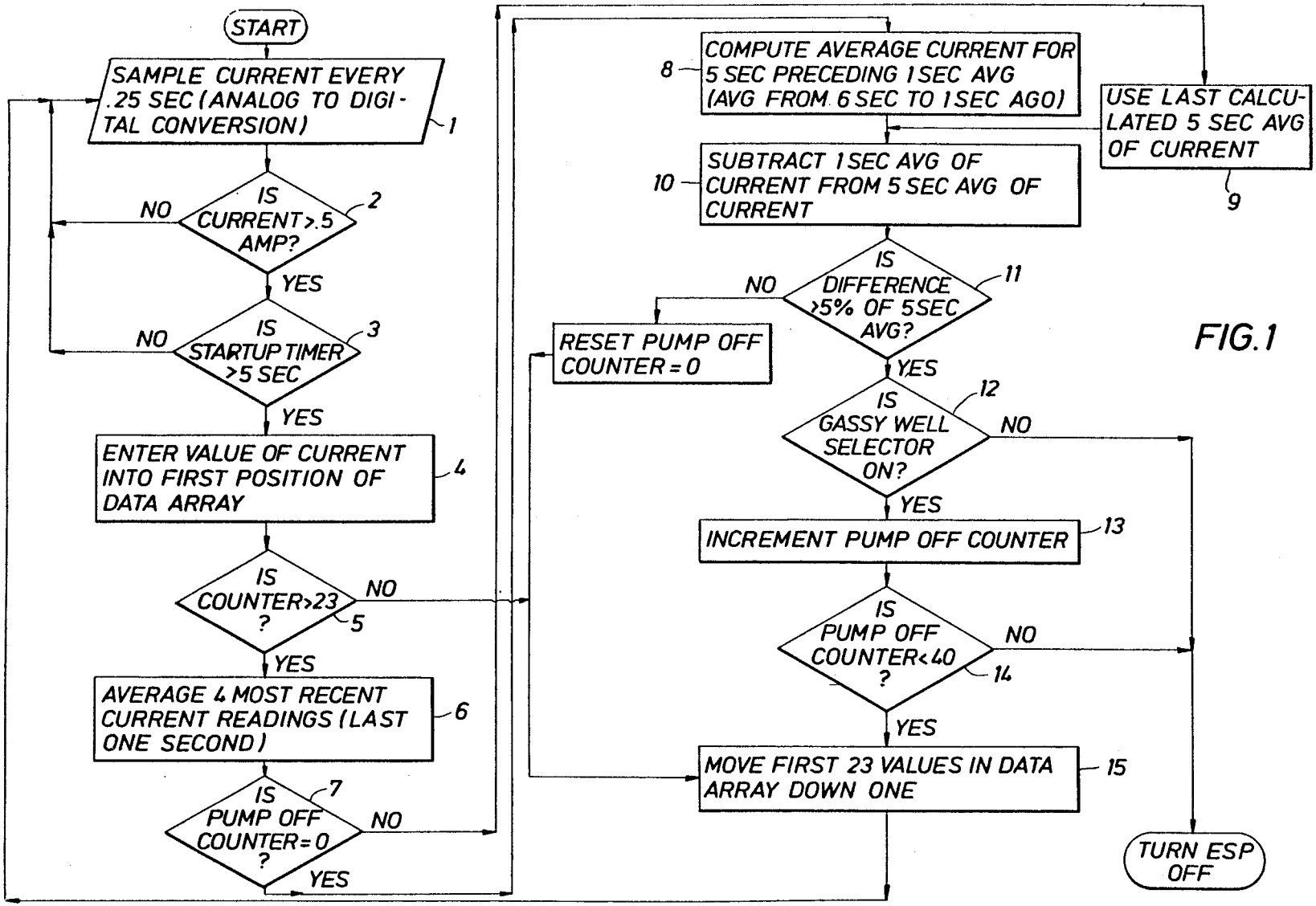
FIG. 1 shows a flow diagram of a preferred controller sequence of steps developed in accordance with the present invention.

In accordance with the present invention several parameters are monitored independently, or in any combination to determine if a change in electrical submersible pump (ESP) motor load has occurred. These are apparent power, actual power, reactive power, power factor, and current (since voltage is generally constant). Each one of these parameters will drop when the ESP motor load drops. Ratios of combinations of these parameters may also be monitored since the ratios will change when motor load drops. If current is used to monitor motor load, voltage may also be measured as a secondary parameter to ensure current fluctuations are not the result of voltage spikes or sags, i.e., current can fluctuate due to other reasons than motor load. For example, the power company may not supply uniform voltages, or storms may cause variations, etc.

Motor load parameters can be measured with a variety of techniques. Parameters can be measured directly or can be first subjected to filtering or smoothing with a root mean square or averaging technique before being measured. Measurements can be taken in an analog fashion with mathematical calculations performed with analog circuitry. Alternatively, analog measurements can be converted to digital and mathematical computations performed with either digital hardware or with software such as in a microprocessor. Digital sampling rates, the length of time evaluated in computations, and data storage requirements are interrelated but can vary widely. In a preferred embodiment, the present invention used an analog-to-digital sampling rate of 4 Hz, although sampling rates less than once every 15 minutes may be used at different time periods, or used in the computations as described hereinafter.

Unlike existing motor control technology that compares motor power or current to a setpoint, the control methods of the present invention utilize various techniques to determine if pump off has occurred as described herebelow. To determine if motor load has dropped, a comparison of the most recent motor load measurements may be made to any previous average motor load. Thus, the most recent motor load measurement can be a single data point or the average of many data points that last occurred. There is no limit to the number of data points or the length of time over which the average can be calculated. Testing of the present invention was successful when using the average of the most recent one second of current and also using just the last single point reading of current. The previous motor load average is preferably computed over any time interval from ESP start to the first data point used in the most recent average. One method of determining the previous motor load is to continually recalculate the moving average of the motor load for any set length of time prior to the most recent average data. There is no limit to the number of data points or the length of time over which the average is calculated. Testing of the present invention has successfully used a moving 5-second average of current. The required degree of drop in the measured motor load parameter must be established in order to identify a potential gas lock or pump off condition. This degree is dependent upon which parameter is being monitored, but is still quite flexible. In accordance with the present invention, a criteria that a current drop must be greater than 5 percent was successfully shown but testing has also indicated that success may be obtained with a criteria anywhere from 1 percent to 20 percent and a wider range of one-quarter percent to 30 percent is possible although errors are more prone to occur in the wider range. In a gassy pumping condition, motor load must drop and remain down for a period of time before the ESP is shut down for gas locking. This required time the motor load must remain down is dependent on the length of time used in the averages in the above steps. In accordance with the present invention, there was successfully tested 10 seconds as one time criteria, but it was easily feasible to use anything greater than 2 seconds. However, this time limit could be cut to zero if longer time periods were used to calculate the two averages of motor loading. The maximum time limit is only a function of how much risk of damage it is possible to take with the ESP before shutting down (for example, an hour or more would be extreme).

Computation of the differential of motor load with respect to time is another way to determine if motor load has dropped.

Motor load is sampled at regular intervals as stated above and the differential motor load is calculated by subtracting the previous motor load from the most recent motor load, and dividing the difference by the time between the two measurements. The previous and most recent motor load values can each be single point measurements or the averages of several measurements. A significant negative result indicates a drop in motor load such as when an ESP is gas locked or pumped off. The degree to which the differential must be negative depends on sampling rates and the time interval over which the differential is calculated. The ESP is pumped off if the differential becomes significantly negative and does not then become significantly positive. The differential method of controller calculation can be performed digitally or in an analog fashion.

Integration of the motor load for a given period of time is yet another way to calculate average motor loads.

Motor load is sampled at regular intervals as stated above and stored in a data array. The area under the motor load versus time curve is calculated for the most recent time period by using an integration technique. The most recent time period can be any length specified by the user depending on the sensitivity required (the shorter the length, the more sensitive the calculation to changes in motor load).

The integration controller calculated method can also be performed digitally or in an analog fashion. Gas locking or pump off is indicated if the most recent integration of motor load is less than the previous integration by a predetermined amount. The length of time over which the integrations are performed, whether the reference integration is calculated at a fixed point in time or on a moving basis, the degree of drop required to be significant, and the time required for the drop to remain down in gassy applications will all vary similarly as in the first method described above.

Finally, another way to determine if motor load has dropped is by performing a statistical analysis of motor load. As in the other methods, motor load is sampled at regular intervals and stored in a data array. The sample distribution satistics are calculated from the previous motor load samples taken for a given length of time and the most recent motor load sample is compared to it. Drops in motor load that fall outside of control limits calculated from the previous motor load sample distribution and the desired sample confidence interval indicate a significant drop in motor load has occurred. The confidence interval that is used is dependent on the probability of error that it is possible to accept and can vary accordingly. If the most recent sample of motor load falls below the calculated lower control limit for a predetermined length of time, then the ESP has gas locked or pumped off and is shut down. Additionally, a statistical calculation in motor load variance or standard deviation indicates that motor load has become more variable, another indication that gas has entered the pump or pump off has occurred.

The ESP pump off/gas locking controller developed in accordance with the present invention can be utilized in several ways. Thus, it is possible to be used as a controller subassembly. The developed controller is wired in series with an existing motor controller to augment/replace the underload functions of the existing controller. Alternatively, the apparatus can be integrated into a single motor controller package. Thus, it is necessary to replace the underload functions in a motor controller with the gas lock/pump off controller functions. Also alternatively, the apparatus of the present invention can be integrated into an intelligent remote terminal unit. This unit exercises motor control functions to include pump off/gas lock control and has the additional capabilities of monitoring ESP operation, storing operation data, and communication with a central computer.

Having thus generally described the apparatus and method of the present invention, as well as its numerous advantages over the art, the following is a more detailed description of a preferred embodiment thereof given in accordance with specific reference to the drawings.

Figure 2:
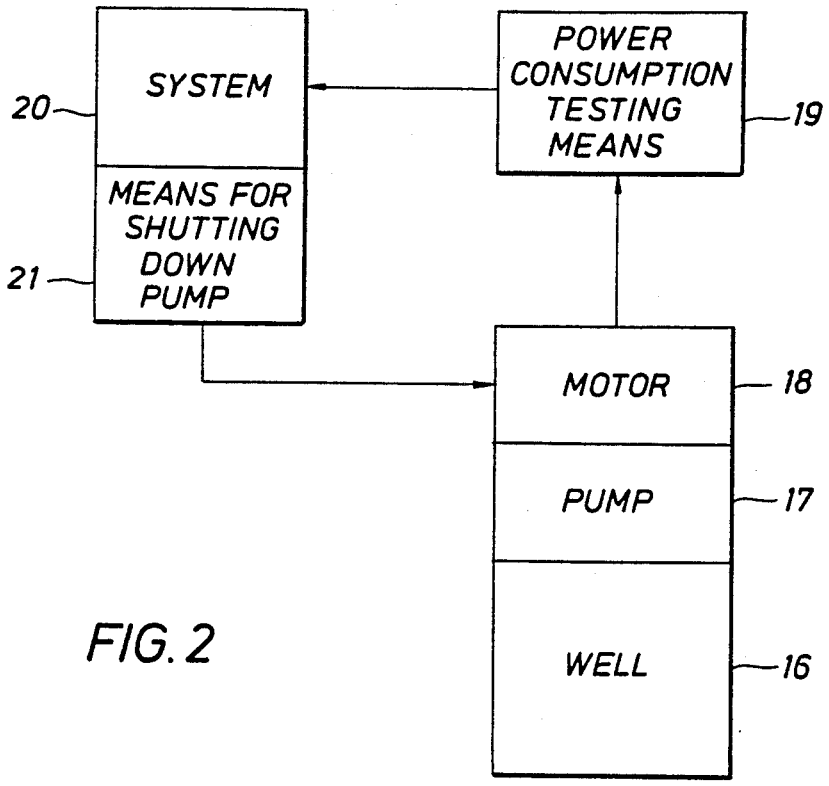
FIG. 2 is a schematic representation of the invention.
Figure 3:
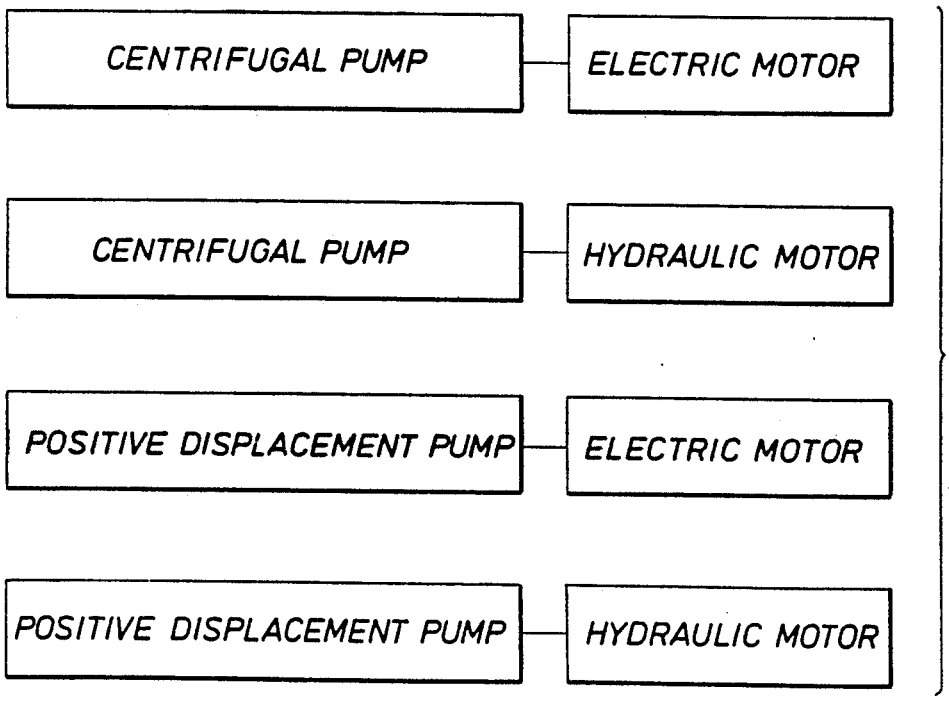
FIG. 3 depicts pump-motor drive combinations.

Referring now to FIG. 2, there is depicted a well 16 having a pump 17 driven by motor 18, which may be electric or hydraulic, for pumping oil and other fluids from underground formations to the surface. A power consumption testing means 19 continuously monitors the power consumed by the motor, and a system 20 compares recent and previous power consumption, and based on the information derived, shuts in the well via means 21 for shutting down the pump.

Step 1: sample current continuously (analog to digital conversion) every 0.25 seconds. Step 2: start controller when current exceeds ½ amp (occurs when ESP is started). Step 3: start controller functions when the current spike on ESP start is over. Step 4: take the most recent sample of current and store it in the first position of the data array for use later in the controller computations. Step 5: after the ESP is started, begin calculations only after the data array is full (6 seconds of current samples). Step 6: calculate the most recent one second average of current by averaging the first four values in the data array. Step 7: if the pump off counter is not equal to zero, then the last calculated difference was more than a 5% drop, indicating that the ESP already has gas in it and may be pumped off. Step 8: if the ESP is not already at potential pump off, calculate the normal previous 5-second average of current by averaging the last 20 samples in the data array. Step 9: if the ESP is already at potential pump off, do not recalculate the previous 5-second average of current. Use the previous average of current calculated when current first dropped in order to compare the most recent current to its original level. Step 10: subtract the most recent 1-second average from the previous 5-second average of current. Step 11: if the calculated difference is greater than a 5% drop, then gas has entered the pump and the ESP is potentially pumped off. Step 12: shut the ESP off in non-gassy pumping conditions since a current drop greater than 5% will only occur at pump off. Step 13: count the length of time the ESP is in a potential pump off condition (one count equals 0.25 seconds). Step 14: in gassy pumping conditions, the ESP has pumped off and is shut down if current does not return to its original 5-second average (before current drop occurred) in 10 seconds or less. Step 15: prepare the data array for the next current sample by bumping the data in the array down one. This effectively erases the oldest current sample and makes room for the next current sample to be added to the top of the array (first position).

While the above description is primarily directed to detecting electrical pump motor underload which is indicative of gas lock or pump off, the basic invention is more broadly drawn to methods and related apparatus for monitoring and controlling pump operation by measuring changes in pump input power. This is done (a) in pumps with electric motor drives by measuring motor load and comparing present motor loads to previous motor loads, (b) in pumps with hydraulic motor drives by measuring hydraulic power consumed (input pressure and flow rate—output pressure and flow rate) and, as above, comparing present motor loads to previous motor loads. Potential pump/motor combinations include (1) centrifugal pump with electric motor drive, (2) centrifugal pump with hydraulic motor drive, (3) positive displacement pump with electric motor drive, (4) positive displacement pump with hydraulic motor drive.

The foregoing description of the invention is merely intended to be explanatory thereof, and various changes in the details of the described method and apparatus may be made within the scope of the appended claims without departing from the spirit of the invention.

What is claimed is:

1. A method for measuring differential pump fluid power output comprising:

(a) measuring pump motor power consumption at timed intervals;

(b) determining a recent pump motor power consumption from the measurements;

(c) determining a previous pump motor power consumption from the measurements;

(d) deriving the difference between steps (b) and (c), the difference being indicative of differential pump fluid power output; and (e) shutting the pump down when said differential exceeds a predetermined amount for a predetermined length of time.

2. A method for detecting loss of pump fluid power output comprising:

(a) measuring pump motor power consumption at timed intervals;

(b) determining a recent pump motor power consumption from the measurements;

(c) determining a previous pump motor power consumption from the measurements;

(d) deriving the difference between steps (b) and (c), the difference being indicative of loss of pump fluid power output when said difference exceeds a predetermined quantity; and (e) shutting the pump motor down when said difference is detected which exceeds a predetermined quantity for a predetermined length of time.

3. Apparatus for measuring differential pump fluid power output comprising:

(a) means for measuring pump motor power consumption at timed intervals;

(b) means for determing a recent pump motor power consumption from the measurements;

(c) means for determing a previous pump motor power consumption from the measurements;

(d) means for deriving the difference between steps (b) and (c), the difference being indicative of loss of differential pump fluid power output when said difference exceeds a predetermined quantity; and (e) means for shutting the pump motor down when said difference exceeds said predetermined quantity.

4. Apparatus for detecting loss of pump fluid power output comprising:

(a) means for measuring pump motor power consumption at timed intervals;

(b) means for determining a recent pump motor power consumption from the measurements;

(c) means for determining a previous pump motor power consumption from the measurements;

(d) means for deriving the difference between steps (b) and (c), the difference being indicative of loss of pump fluid power output when said difference exceeds a predetermined quantity; and (e) means for shutting the pump motor down when said loss of pump fluid power output is detected which exceeds a predetermined quantity for a predetermined length of time.

5. The apparatus of claim 3 or 4 wherein the pump motor drive is selected from (1) an electric motor and (2) a hydraulic motor.

6. The apparatus of claim 3 or 4 wherein the pump is utilized with a motor drive selected from one of the following combinations: (1) a centrifugal pump with an electric motor, (2) a centrifugal pump with an hydraulic motor, (3) a positive displacement pump with an electric motor drive, (4) a positive displacement pump with a hydraulic motor drive.

7. A method for detecting electrical submersible pump motor underload, comprising:

(a) measuring pump motor loads at timed intervals;

(b) determining a recent pump motor load from the measurements;

(c) determining a previous pump motor load from the measurements;

(d) deriving the difference between steps (b) and (c), the difference being indicative of pump motor underloaded when said difference exceeds a predetermined quantity; and (e) shutting the pump motor down when said underload is detected.

8. A method for detecting electrical submersible pump motor underloaded, comprising:

(a) measuring pump motor loads at timed intervals;

(b) determining a recent pump motor load from the measurements;

(c) determining a previous pump motor load from the measurements;

(d) deriving the difference between steps (b) and (c), the difference being indicative of pump motor underload when said difference exceeds a predetermined quantity; and (e) shutting the pump motor down when said underload is detected which exceeds a predetermined length of time.

9. The method of claim 7 wherein said motor loads are monitored from apparent power utilized by said pump motor.

10. The method of claim 7 wherein said motor loads are monitored from actual power utilized by said pump motor.

11. The method of claim 7 wherein said motor loads are monitored from reactive power utilized by said pump motor.

12. The method of claim 7 wherein said motor loads are monitored from power factor utilized by said pump motor.

13. The method of claim 7 wherein said recent motor load is an average of measurements computed over a selected time interval.

14. The method of claim 7 wherein step (d) is based on a computation of the differential of motor load with respect to time.

15. The method of claim 7 wherein step (d) is based on integration of motor load with respect to time.

16. The method of claim 7 wherein step (d) is based on statistical analysis.

17. The method of claim 7 wherein said motor loads are monitored from current utilized by said pump motor.

18. The method of claim 17 wherein voltage accompanying said current is utilized to screen out corresponding current fluctuations which are the result of voltage spikes or sags and not pumpoff or gas locking.

19. The method of claim 7 wherein the most recent motor load measurement is used in step (b).

20. The method of claim 19 wherein said most recent motor load measurement is based on more than one measurement.

21. The method of claim 7 or 20 wherein said previous motor load is based on more than one measurement.

22. The method of claim 7 or 13 wherein said previous motor load is an average of measurements computed over a selected time interval.

23. A method for detecting electrical submersible pump motor underload, comprising:

(a) measuring motor current at timed intervals;

(b) determining the most recent motor current from the measurements;

(c) determining a moving average of the previous motor current from the measurements;

(d) derving the difference between steps (b) and (c), the difference being indicative of pump motor underload when said difference exceeds a predetermined quantity; and (e) shutting the pump motor down when said difference exceeds one percent and wherein oil is being pumped in a non-gassy pumping condition.

24. A method for detecting electrical submersible pump motor underload, comprising:

(a) measuring motor current at timed intervals;

(b) determining the most recent motor current from the measurements;

(c) determining a moving average of the previous motor current from the measurements;

(d) deriving the difference between steps (b) and (c), the difference being indicative of pump motor underload when said difference exceeds a predetermined quantity; and (e) shutting the pump motor down when said difference exceeds one percent for more than two seconds and wherein oil is being pumped in a gassy pumping condition.

25. An apparatus for detecting electrical submersible pump motor underload, comprising:

(a) means for measuring pump motor loads at timed intervals;

(b) means for determining a recent pump motor load from the measurements;

(c) means for determining a previous pump motor load from the measurements;

(d) means for deriving the difference between steps (b) and (c), the difference being indicative of pump motor underload when said difference exceeds a predetermined quantity; and (e) means for shutting the pump motor down when said underload is detected.

26. An apparatus for detecting electrical submersible pump motor underload, comprising:

(a) means for measuring pump motor loads at timed intervals;

(b) means for determining a recent pump motor load from the measurements;

(c) means for determining a previous pump motor load from the measurements;

(d) means for deriving the difference between steps (b) and (c), the difference being indicative of pump motor underload when said difference exceeds a predetermined quantity; and (e) means for shutting the pump motor down when said underload is detected which exceeds a predetermined length of time.

27. The apparatus of claim 25 including means for monitoring said motor load from apparent power utilized by said pump motor.

28. The apparatus of claim 25 including means for monitoring said motor loads from actual power by said pump motor.

29. The apparatus of claim 25 including means for monitoring said motor loads from reactive power utilized by said pump motor.

30. The apparatus of claim 25 including means for monitoring said motor loads from a power factor indicated by said pump motor.

31. The apparatus of claim 25 including means for monitoring said motor loads from current utilized by said pump motor.

32. An apparatus for detecting electrical submersible pump motor underload, comprising:

(a) means for measuring motor current at timed intervals;

(b) means for determining the most recent motor current from the measurements;

(c) means for determining a moving average of the previous motor current from the measurements;

(d) means for deriving the difference between steps (b) and (c), the difference being indicative of pump motor underload when said difference exceeds a predetermined quantity; and (e) means for shutting the pump motor down when said difference exceeds one percent and wherein oil is being pumped in a non-gassy pumping condition.

33. The apparatus of claims 25 or 32 applied as a controller subassembly wired in series with a motor controller, said controller subassembly being functional to augment or replace underload functions of said motor controller.

34. The apparatus of claims 25 or 32 applied as an integrated motor controller package functional to replace underload functions of a motor controller with gas lock/pump off controller functions.

35. The apparatus of claims 25 or 32 applied as an integrated intelligent remote terminal unit functional to excercise motor control functions to include pump off-/gas lock control and have capabilities of monitoring electrical submersible pump operation parameters, storing operation data and communication with a central computer.

36. An apparatus for detecting electrical submersible pump motor underload, comprising:

(a) means for measuring motor current at timed intervals;

(b) means for determining the most recent motor current from the measurements;

(c) means for determining a moving average of the previous motor current from the measurements;

(d) means for deriving the difference between steps (b) and (c), the difference being indicative of pump motor underload when said difference exceeds a predetermined quantity; and (e) means for shutting the pump motor down when said difference exceeds one percent for more than two seconds and wherein oil is being pumped in a gassy pumping condition.

* * * * *